United States Patent [19]

Imberg et al.

[11] 3,985,993

[45] Oct. 12, 1976

[54] SEALING ARRANGEMENT IN A MICROWAVE OVEN

[75] Inventors: Bengt Uno Imberg; Kurt Håkan Karlsson; Gustav Georg Orke, all of Norrkoping, Sweden

[73] Assignee: U.S. Philips Corporation, New York, N.Y.

[22] Filed: Aug. 29, 1974

[21] Appl. No.: 501,481

[52] U.S. Cl. ..... 219/10.55 D

[51] Int. Cl.[2] ..... H05B 9/06

[58] Field of Search ..... 219/10.55 D; 174/35 GC, 174/35 MS, 35 R

[56] References Cited

UNITED STATES PATENTS

| | | | |
|---|---|---|---|
| 2,796,457 | 6/1957 | Stinger | 174/35 GC |
| 2,958,754 | 11/1960 | Hahn | 219/10.55 D |
| 3,629,537 | 12/1971 | Haageusen | 219/10.55 D |
| 3,668,357 | 6/1972 | Kobayashi | 219/10.55 D |
| 3,767,884 | 10/1973 | Osepchuk et al. | 219/10.55 D |
| 3,809,843 | 5/1974 | Takayama | 219/10.55 D |
| 3,835,283 | 9/1974 | Suzuki | 219/10.55 D |

*Primary Examiner*—Bruce A. Reynolds
*Attorney, Agent, or Firm*—Frank R. Trifari

[57] ABSTRACT

A sealing arrangement for microwave ovens comprising a quarter wave choke situated in the door and having an entrance opening into the choke in the rim portions of the door, which consists of a door frame, and a suitably perforated metallic door sheet covering the space inside the frame. According to the invention the door frame comprises an integral piece of conductive material having, in section, a generally U-shaped configuration, forming said quarter wave choke, with the outer leg of the U shorter than the inner leg, the door sheet is situated in a plane with the outer end of the inner leg of the U, where it is electrically connected to the said leg. The metallic door sheet extends beyond the inner leg and beyond the shorter, outer leg of the U so that the entrance opening to the inside of the U, forming the cavity of the quarter wave choke, is constituted by the gap between the outer shorter leg of the U and the extension of the metallic door sheet.

11 Claims, 2 Drawing Figures

SEALING ARRANGEMENT IN A MICROWAVE OVEN

Figure 1:
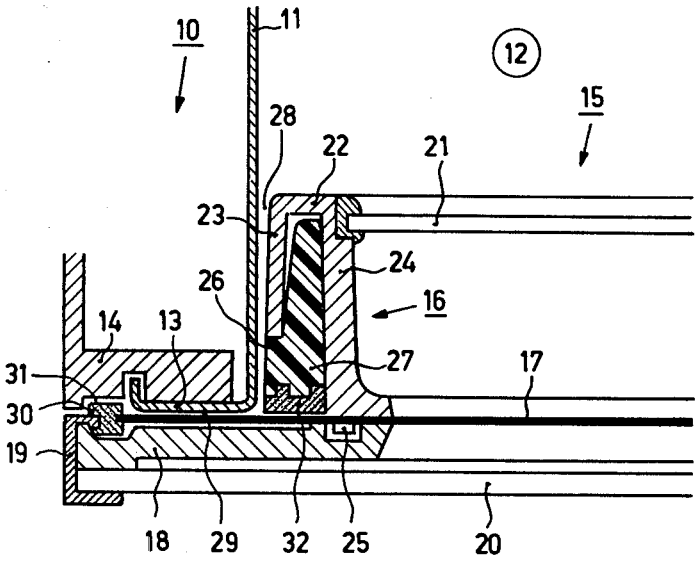

The invention relates to a sealing arrangement for a microwave oven having an oven cavity defined by side walls of electrically conductive material and a substantially rectangular access opening, which is closed by a lid or a door, consisting of a frame extending around all four sides of the door and a suitably perforated sheet covering the space inside the frame. The door is provided with an electric sealing device for preventing leakage of energy said device being in the shape of a so called quarter-wave length choke having an entrance opening in the rim portions of the door situated opposite but at a small distance from conductive wall portions of the cavity.

A quarter-wave length choke consists in principle of a usually rectangular cavity having an entrance opening in one of its sidewalls and a depth, as measured from the opening to a short-circuiting wall, amounting to a quarter of a wavelength of the oven microwave energy. In the said choke arrangement, where the entrance opening to the choke is situated in the rim portions of the door, it is common practice to locate the entrance opening to the choke near the outer edges of the said rim portions as seen from the oven cavity and to select as the short-circuiting wall that wall of the choke space which adjoins the oven cavity. The suitably perforated metal sheet, which covers the space inside the door frame, is then fastened to the door frame in a plane with the bottom wall of the choke which adjoins the oven cavity and serves as the short-circuiting wall.

The function of the choke can be described as follows: the low resistance at the short-circuiting wall is transformed to a very high resistance at the choke entrance opening, which high resistance in turn is transformed to a low resistance at the entrance to a gap leading from the oven cavity to the choke entrance opening and which gap also has a length of a quarter of a wavelength. The leaking energy thus will "see" the low resistance at the input of the said gap and under ideal conditions leakage is thereby prevented.

In order to ensure that the choke is highly effective for suppressing leaking energy, it is inter alia also required that the resistance at the short-circuiting wall be as near to zero as possible. Measures therefore must be taken during the manufacture of the door to ensure that the short-circuit at the bottom of the choke is effective.

Usually the door frame is assembled from pieces which are welded together or screwed together, at least one joint being present at the bottom of the choke where the short-circuiting wall is formed. The said welded joint then must insure that good electric contact is present between the joined parts along the whole length of the joint. The sheet covering the inner part of the door frame is usually also fastened to the door frame at the bottom of the choke, which likewise must be carried out very carefully and may be effected by welding in order to ensure good electric contact between the sheet and the door frame. This is necessary because an interruption in the said electric contact at any place along the circumference of the door frame might produce a path for leaking energy directly from the inside of the cavity to the surroundings.

An object of the invention is to produce a door construction provided with a choke which is more simple and less expensive to manufacture than known constructions but which in spite of this will give an improved sealing action against leaking energy.

According to the invention this is achieved by providing a door frame that consists of an integrally made profile having a substantially U-shaped section composed of an electrically good conductive material with the base of the U, as seen in a sectional view, facing inwardly to the inside of the cavity and with the outer leg of the U, which leg forms a portion of the rim portions of the door, shorter than the inner leg of the U. In addition, the suitably perforated sheet which covers the inside of the frame is arranged in a plane with the outer end of the longer inner leg. This sheet is electrically connected with the said end of the longer leg and extends beyond the same and beyond the shorter outer leg so that the entrance opening to the choke is formed by the gap between the sheet and the outer end of the shorter leg of the U-shaped profile of the door frame.

Owing to the fact that the quarter wave choke is formed by the U-shaped portion of the door frame which is made in one integral piece of good conductive material, the best possible short circuiting will be obtained. As a result of this construction there is no joint in the short circuiting wall which is constituted by the base of the U-shaped section. The only joint present is at the opposite end, that is to say, at the connection between the longer inner leg and the perforated sheet which covers the inside of the door frame. At this location, however, there is no requirement that a continuous short-circuit wall of high quality be present around the whole circumference, but it is sufficient that leaking paths for microwave energy be prevented from occurring at the said connection. For this purpose the said connection can be obtained in a simple and cheap manner by means of a number of teeth projecting from the inner leg and evenly distributed along the circumference, which teeth are introduced into corresponding apertures in the sheet. The electric contact is ensured by a pressing operation whereby the materials in the teeth on the door frame and the sheet are made to cut into each other, for example due to a conic shape of the teeth or projecting bars on the teeth. With a sufficient close location of the teeth it is then only necessary that electric contact be established at any place on each tooth.

In order to further improve the action against leaking energy, and to suppress energy which possibly passes the quarter-wave choke or the said connection between the door frame and the door sheet, respectively, an absorbing material can be arranged at the open end of the U-profile in direct connection with the choke and the door sheet. The entrance opening to the choke is then formed between the shorter outer leg of the U-profile and the said absorbing material. Leaking energy passing the entrance opening to the choke then also must pass this absorbing material and will thereby be attenuated. Leaking energy, if any, which propagates through the connection between the door frame and the door sheet will also be heavily damped as it must also pass through the said absorbing material situated outside the choke. In the usual manner further absorbing material also is suitably arranged at a subsequent place as seen in the propagation direction for the leaking energy, which in combination with previously described measures will result in a very small energy leakage.

The invention is illustrated in the accompanying drawing which shows in FIG. 1 a sectinnal view through a door shaped in accordance with the invention and a side wall of the cavity in the closed position of the door.

Figure 2:
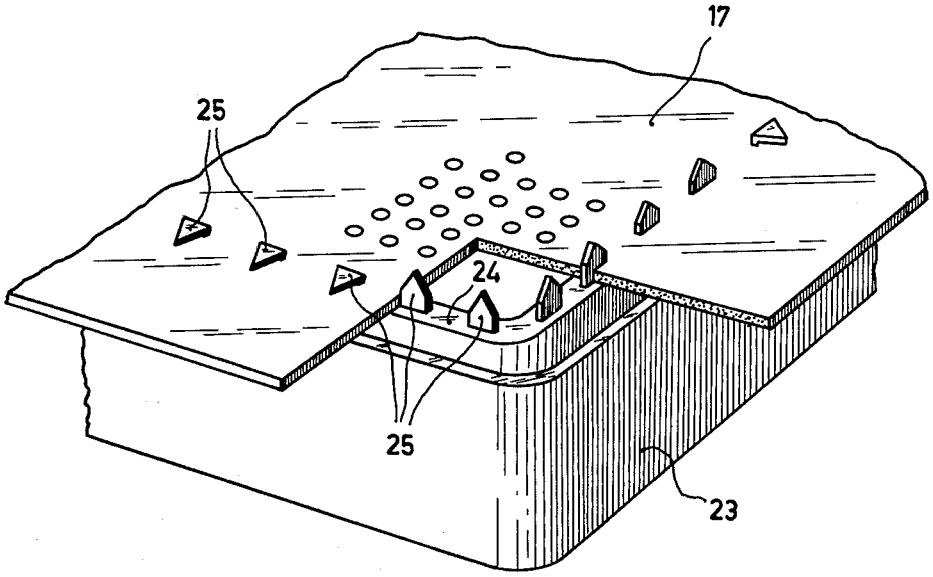

FIG. 2 is a perspective view showing the teeth in the inner leg projecting through apertures in the door sheet.

In the drawing reference numeral 10 designates a side wall of a microwave oven comprising an inner metal sheet 11 which defines an oven cavity 12. An access opening to the cavity is limited by a front sheet 13, which is a continuation of the wall sheet 11 and which extends into a front frame 14. The access opening is closed by a door or a lid 15.

The door consists as to its essential parts of an inner door frame 16 and a metallic door sheet 17. Furthermore there is an outer door frame 18 and a decorative strip 19. If the door sheet is perforated in order to enable observation of the inside of the cavity, an outer covering disk 20 of glass or plexiglass can be provided, together with an inner covering disk 21 also made of glass or plexiglass, in order to prevent dirtying of the sheet and the outer covering disk.

According to the invention the door frame is shaped as an integral substantially U-shaped profile, the bottom or base portion of which in the drawing is designated by reference numeral 22 and the legs by reference numerals 23 and 24. The U-profile is so oriented that in the closed position of the door the bottom portion 22 adjoins the oven cavity 12. The outer leg 23, which forms the rim portion of the door, is as shown somewhat shorter than the inner leg 24. The door sheet 17 is electrically connected to the longer, inner leg 24 by means of a large number of teeth 25 (FIG. 2) projecting from the leg 24, which teeth are pressed into corresponding apertures in the door sheet. A gap 26 between the shorter outer leg 23 and the door sheet 17 forms an entrance opening to the inside of the U-profile, which is formed as a quarter-wave choke. The short-circuiting wall in the choke is formed by the bottom connecting part 22 of the U-profile. The U-profile can, for example, be die-casted from aluminium which will result in good electric properties for the choke. The inside of the choke is suitably filled with a choke strip 27 made of plastic material or the like, for example polypropene. A gap 28 between the rim portions of the door and the cavity wall 11 forms an entrance gap to the choke and in a corresponding manner an output gap 29 for the choke is formed between the door sheet 17 and the front sheet 13. A strip 30 of energy absorbent damping material is mounted on the outer edge of the door sheet, which strip projects into a recess 31 in the front frame 14. And finally a strip 32 of energy absorbent damping material is mounted at the open end of the U-shaped profile. In the example shown strip 32 is fastened to the plastic filler 27 in the U-profile.

The assembly is simple and may for example be effected as follows:

The inner door frame 16 is placed with the opening of the U-profile facing upwardly and the choke strip 27 is placed in the opening. The damping strip 32 is placed upon the choke strip. The door sheet 17 is placed on the inner door frame and the parts are pressed together. The outer damping strip 30 is placed upon the door sheet. The outer door frame is placed upon this unit and fastened by a pressing operation. Thereafter there is carried out in successive order the assembly of possible door arms, inner covering disk, outer covering disk, decorative strip and finally the unit is screwed together.

What is claimed is:

1. A sealing arrangement in a microwave oven having an oven cavity defined by side walls of electrically conductive material and conductive wall portions defining a substantially rectangular access opening, a door for closing said access opening including a frame extending around the door and a perforated sheet covering the space situated inside the frame, a microwave energy seal comprising a quarterwave choke located in the rim portion of the door and having an entrance opening in the rim portions of the door lying opposite to and spaced apart from said conductive wall portions of the cavity, the door frame comprising an integral profile having a substantially U-shaped section of an electrically conductive material with the base of the U, as seen in a sectional view, facing inwardly to the inside of the cavity and with the outer leg of the U forming a portion of the rim portions of the door and being shorter than the inner leg of the U, said perforated sheet being arranged in a plane with the outer end of the inner leg, and means electrically connecting said sheet with said end of the longer inner leg with the sheet extending beyond the inner and the outer legs of the U so that the entrance opening to the choke is formed by the intermediate space between the sheet and the outer shorter leg of the U-shaped profile of the door frame.

2. A sealing arrangement as claimed in claim 1 wherein said electrical connecting means comprises, a plurality of teeth projecting from said inner leg and evenly distributed along the circumference, which teeth are introduced into corresponding apertures in the sheet with electric contact being enhanced in that the material in the teeth and the sheet material are made to cut into each other by pressing same together.

3. A sealing arrangement as claimed in claim 1 further comprising an energy absorbent material located outside the entrance opening to the quarter-wave choke as seen in the propagation direction for leaking energy in a space adjoining directly to the quarter-wave choke and said sheet in order to attenuate leaking energy passing the choke entrance opening and leaking energy which propagates through the connection between the longer inner leg of the U-shaped profile of the door frame and the perforated sheet.

4. A sealing arrangement as claimed in claim 1 wherein the oven cavity walls further comprise second conductive wall portions in planes different from those of the first conductive wall portions and wherein the door sheet extends beyond the outer shorter leg of the U-shaped profile so that in the closed position of the door it is situated opposite and close to the second conductive wall portion of the cavity walls thereby forming an output gap for the choke.

5. A sealing arrangement as claimed in claim 4, characterized in that an energy absorbent damping material is arranged at the end of said output gap.

6. A microwave oven comprising, an oven cavity defined by walls made of electrically conductive material including conductive wall portions defining an access opening, a door for closing said access opening including a frame comprising an integral member composed of a conductive material and having a generally U-shaped section configuration forming a quarter wave microwave energy cavity seal in the peripheral rim of the door frame confronting said conductive wall portions, the outer leg of the U forming part of said rim and being shorter than the inner leg of the U and the base of the U being located adjacent the oven cavity, and a metallic door sheet covering the space inside the door frame and situated in a plane with the outer end of the innerleg of the U and making good electrical contact therewith.

7. A microwave oven as claimed in claim 6 wherein said door sheet extends beyond the inner and outer legs of the U so that the entrance opening of the quarter wave cavity formed inside the U is made up of a gap formed between the outer leg of the U and the extended part of the metallic door sheet.

8. A microwave oven as claimed in claim 6 wherein said electrical contact between the door sheet and inner leg of the U is formed by a plurality of teeth projecting from the inner leg and distributed about its circumference which mate with corresponding apertures in the door sheet.

9. A microwave oven as claimed in claim 6 wherein said door sheet extends beyond the outer leg of the U in confronting but spaced relation to second conductive wall portions of the oven cavity lying in planes approximately perpendicular to the respective planes of the conductive wall portions defining the access opening.

10. A microwave oven as claimed in claim 9 further comprising an energy absorbent material located outside the entrance opening of the quarter wave energy seal and confronting a part of the door sheet thereby to attenuate microwave energy leaking past said entrance opening and energy leaking through the electrical contact between the door sheet and the inner leg of the U.

11. A microwave oven as claimed in claim 6 wherein the base of the U confronts and is adjacent to the oven cavity and lies in a plane perpendicular to the conductive wall portions defining the access opening and parallel to the plane of the door sheet.

* * * * *